US007581992B1

(12) United States Patent
Liu et al.

(10) Patent No.: US 7,581,992 B1
(45) Date of Patent: Sep. 1, 2009

(54) POWER ADAPTER

(75) Inventors: Calvin Y. Liu, Irvine, CA (US); Lynn Lee, Arcadia, CA (US); Frank Hung, Irvine, CA (US)

(73) Assignee: Cisco Technology, Inc., San Jose, CA (US)

( * ) Notice: Subject to any disclaimer, the term of this patent is extended or adjusted under 35 U.S.C. 154(b) by 469 days.

(21) Appl. No.: 10/917,024

(22) Filed: Aug. 11, 2004

(51) Int. Cl.
*H01R 25/00* (2006.01)

(52) U.S. Cl. ..... 439/651; 439/929

(58) Field of Classification Search ..... 439/501, 439/502, 651, 650, 653, 929; 320/111, 114, 320/115

See application file for complete search history.

(56) References Cited

U.S. PATENT DOCUMENTS 5,587,645 A * 12/1996 Sciammarella et al. ..... 362/253
5,641,588 A 6/1997 Sieminski et al.
6,316,911 B1 * 11/2001 Moskowitz et al. ..... 320/114
6,608,412 B2 8/2003 Horng et al.
6,632,883 B2 * 10/2003 Mayes et al. ..... 525/98

* cited by examiner

*Primary Examiner*—Javaid Nasri
(74) *Attorney, Agent, or Firm*—Haynes and Boone, LLP

(57) ABSTRACT

Systems and methods are disclosed herein to provide improved techniques for connecting an electrical device to an external power source. For example, in accordance with an embodiment of the present invention, an electrical device is disclosed having various types of connections to a power source. The connections may also provide power transformation.

16 Claims, 6 Drawing Sheets

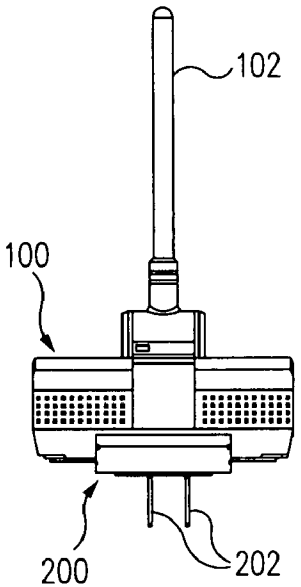
FIG. 3c
FIG. 3b
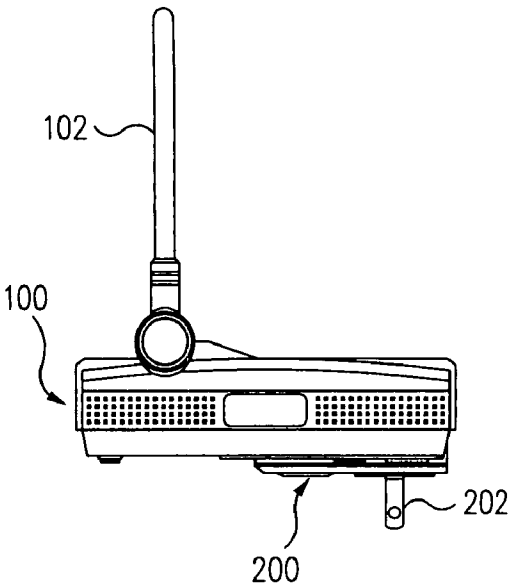
FIG. 3a

POWER ADAPTER

TECHNICAL FIELD

The present invention relates generally to electrical devices and, more particularly, to power adapters or connectors for electrical devices.

BACKGROUND

An electrical device often requires a connection to a power supply in order for the electrical device to receive the necessary power to operate. For example, a wireless network range expander typically must be connected to a power outlet via a power supply cord to receive power and operate properly. As another example, a portable device (e.g., a laptop computer, a portable telephone, or a personal digital assistant (PDA) device) that operates by receiving power from an internal battery may also need to be periodically connected to an external power supply via a power supply cord to recharge the battery.

One drawback associated with the electrical device is that when a user plugs in the power supply cord to connect the electrical device to a power outlet, the power supply cord is often cumbersome and unwieldy and may be a hazard to pedestrians who may trip on the power supply cord. Furthermore, there may be no convenient location to place the electrical device once it is connected to the power outlet (e.g., while the electrical device is recharging).

Additionally, a user may desire to have an alternative to the power supply cord for connecting the electrical device to the power outlet, especially if the power supply cord includes a power transformer (e.g., an alternating current (AC) adapter for converting AC power to direct current (DC) power). For example, it may be difficult to plug in a power supply cord having a power transformer if there is not sufficient room to accommodate the power transformer. As a result, there is a need for improved techniques for connecting an electrical device to an external power source (e.g., a power outlet).

SUMMARY

Systems and methods are disclosed herein to provide improved techniques for connecting an electrical device to an external power source. For example, in accordance with an embodiment of the present invention, an electrical device is disclosed having various types of connections to a power source. As an example, the electrical device may have different types of interchangeable power connectors (or couplers) that can attach to the electrical device and provide a connection to the power source (e.g., a power outlet). One type of power coupler has a standard power supply cord to allow the electrical device to be plugged into the wall outlet to receive power. Another type of power coupler has only prongs (i.e., no power supply cord) for plugging directly into the wall outlet. A user may select the desired power coupler to couple to the electrical device based upon the user's requirements.

The power couplers may also include a power transformer to provide the proper power conversion for the electrical device. Consequently, the electrical device may be utilized throughout the world, with the power coupler selected based on the location and taking into account plug configuration and power source.

More specifically, in accordance with one embodiment of the present invention, an apparatus includes an electrical device; at least one terminal, coupled to the electrical device, adapted to provide a path for electrical power to the electrical device; two or more power connectors adapted to be selectively coupled to the at least one terminal and provide a path for electrical power from an external power supply to the electrical device. Each of the power connectors having at least one power terminal adapted to couple to the corresponding terminal of the apparatus; and at least one electrical prong adapted to couple to the external power supply; wherein a first one of the power connectors is adapted to selectively couple to the apparatus, with the at least one electrical prong adapted to plug directly into an electrical outlet of the external power supply; and wherein a second one of the power connectors further comprises an electrical cord adapted to couple the at least one electrical prong to the at least one power terminal, with the at least one electrical prong adapted to plug directly into an electrical outlet of the external power supply via the electrical cord.

In accordance with another embodiment of the present invention, a plurality of power connectors includes a first power connector having a plurality of first electrical prongs for coupling to a power supply and a plurality of first power terminals for coupling to corresponding terminals of an electrical device, wherein the first power connector supports the electrical device while the first power connector is coupled to the power supply; and a second power connector having an electrical cord and a plurality of second electrical prongs for coupling to the power supply via the electrical cord, and a plurality of second power terminals for coupling to the corresponding terminals of the electrical device, wherein the first power connector or the second power connector is selectively coupled to the electrical device.

In accordance with another embodiment of the present invention, a method of providing power from a power supply to an electrical device includes providing two or more power adapters adapted to selectively couple to the electrical device and provide a path for power from the power supply to the electrical device, wherein a first one of the power adapters couples the electrical device directly to the power supply via one or more electrical prongs and a second one of the power adapters has an electrical cord with a plug and one or more electrical prongs to couple the electrical device to the power supply; selecting which of the power adapters to couple to the electrical device; coupling the selected power adapter to the electrical device; and coupling the selected power adapter, which is coupled to the electrical device, to the power supply.

In accordance with another embodiment of the present invention, an apparatus includes an electrical device having at least one terminal for providing a path for electrical power to the electrical device; and means for selectively coupling the at least one terminal to an external power supply, wherein the coupling means comprises at least a first coupling means and a second coupling means which are selectively coupled to the at least one terminal, the first coupling means adapted to directly couple the at least one terminal to an electrical outlet of the external power supply and suspend the apparatus from the electrical outlet, the second coupling means adapted to couple the at least one terminal to the electrical outlet which is distant from the apparatus.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

FIGS. 3*a*, 3*b*, and 3*c* show front, side, and bottom views illustrating the power connector of FIG. 2 coupled to the electrical device of FIG. 1 in accordance with an embodiment of the present invention.

Embodiments of the present invention and their advantages are best understood by referring to the detailed description that follows. It should be appreciated that like reference numerals are used to identify like elements illustrated in one or more of the figures.

DETAILED DESCRIPTION

Figure 1A:
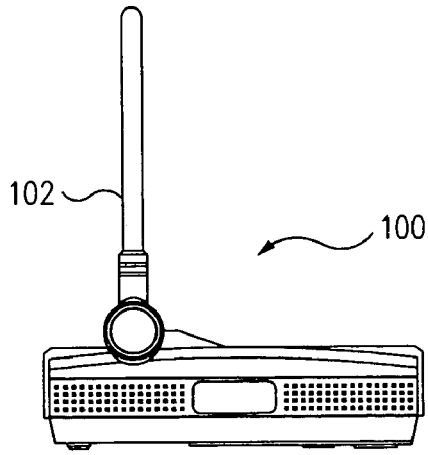
FIGS. 1*a*, 1*b*, and 1*c* show front, side, and bottom views illustrating an electrical device in accordance with an embodiment of the present invention.
Figure 1B:
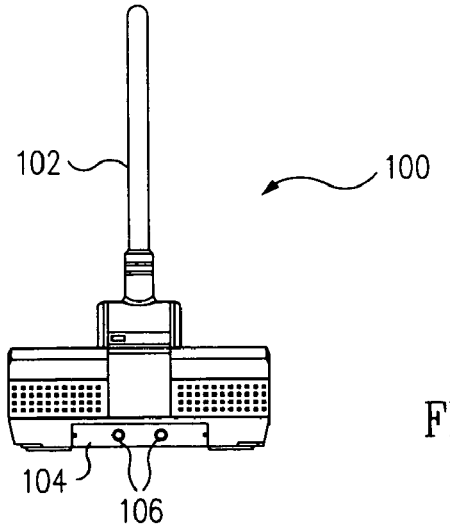
Figure 1C:
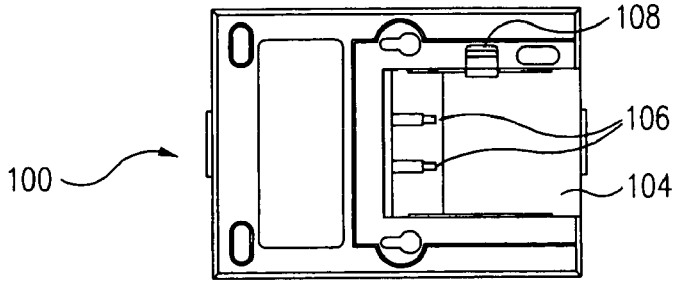

FIGS. 1*a*, 1*b*, and 1*c* show front, side, and bottom views illustrating an electrical device 100 in accordance with an embodiment of the present invention. Electrical device 100 may represent any type of electrical device that may need to be connected to an external power source. As an example, electrical device 100 may represent a wireless network range expander having an antenna 102, which for example functions to expand a wireless network's range beyond the range of the current access point or wireless router (e.g., by repeating the wireless signal to devices within the expander's range).

Electrical device 100 may require that an external power source be supplied in order for electrical device 100 to operate. Alternatively, electrical device 100 may require that an external power source be supplied periodically to recharge an internal battery or batteries of electrical device 100. In either of these examples, electrical device 100 will need to be connected to an external power source at some point in time (e.g., temporarily or possibly permanently).

Electrical device 100 includes terminals 106 through which electrical power is provided to electrical device 100. The number of terminals 106 may be varied, depending upon the desired application or requirements. For example, two of terminals 106 are shown in FIG. 1, but one, three, or more terminals may be implemented. As an example, three of terminals 106 may be implemented in electrical device 100 (e.g., a standard three plug power connection with one plug functioning as a ground plug).

Terminals 106 are connected to an external power source via a power connector (not shown in FIG. 1), which is described in detail herein (e.g., in reference to FIGS. 2 and 5). The power connector (also referred to herein as a power coupler or a power adapter) provides a path between terminals 106 and an external power source through which electrical device 100 receives its power.

Figure 2A:
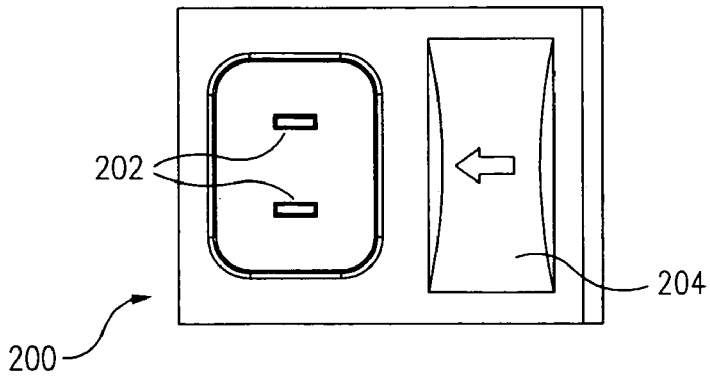
FIGS. 2*a*, 2*b*, and 2*c* show bottom, end, and side views illustrating a power connector for the electrical device of FIG. 1 in accordance with an embodiment of the present invention.
Figure 2B:
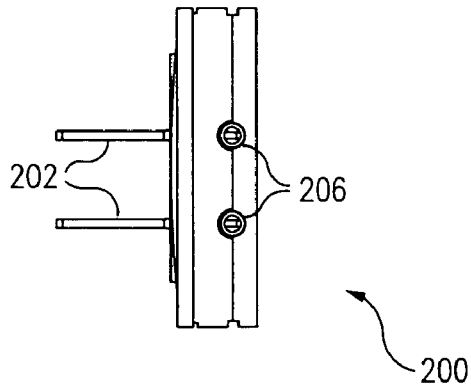
Figure 2C:
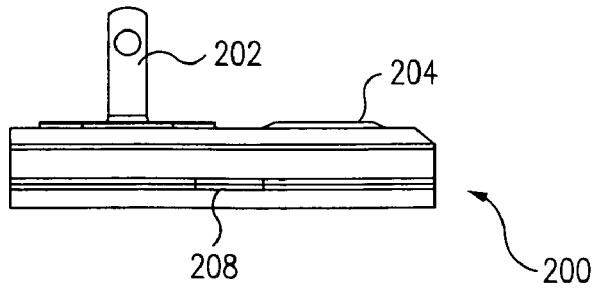

For example, FIGS. 2*a*, 2*b*, and 2*c* show bottom, end, and side views illustrating a power connector 200 for electrical device 100 of FIG. 1 in accordance with an embodiment of the present invention. Power connector 200 includes electrical prongs 202 and terminals 206. Prongs 202 are inserted into a power outlet while terminals 206 connect to terminals 106 of electrical device 100 to allow electrical power to be provided to electrical device 100 through prongs 202 and terminals 206.

Power connector 200 may be designed to couple to or be inserted into electrical device 100. For example, power connector 200 may include a raised portion 204 to provide a user of electrical device 100 an area to apply pressure to power connector 200 to aid in the attachment or removal of power connector 200 to or from electrical device 100. There may also be an indentation 208 to allow power connector 200 to be latched into place when joined with electrical device 100.

As an exemplary implementation, FIGS. 3*a*, 3*b*, and 3*c* show front, side, and bottom views illustrating power connector 200 of FIG. 2 coupled to electrical device 100 of FIG. 1 in accordance with an embodiment of the present invention. When power connector 200 is inserted into electrical device 100 for this example, terminals 106 are joined (or mated) with terminals 206 to provide an electrical connection. Power connector 200 may be latched into place via a latch 108 that snaps into indentation 208.

Figure 4:
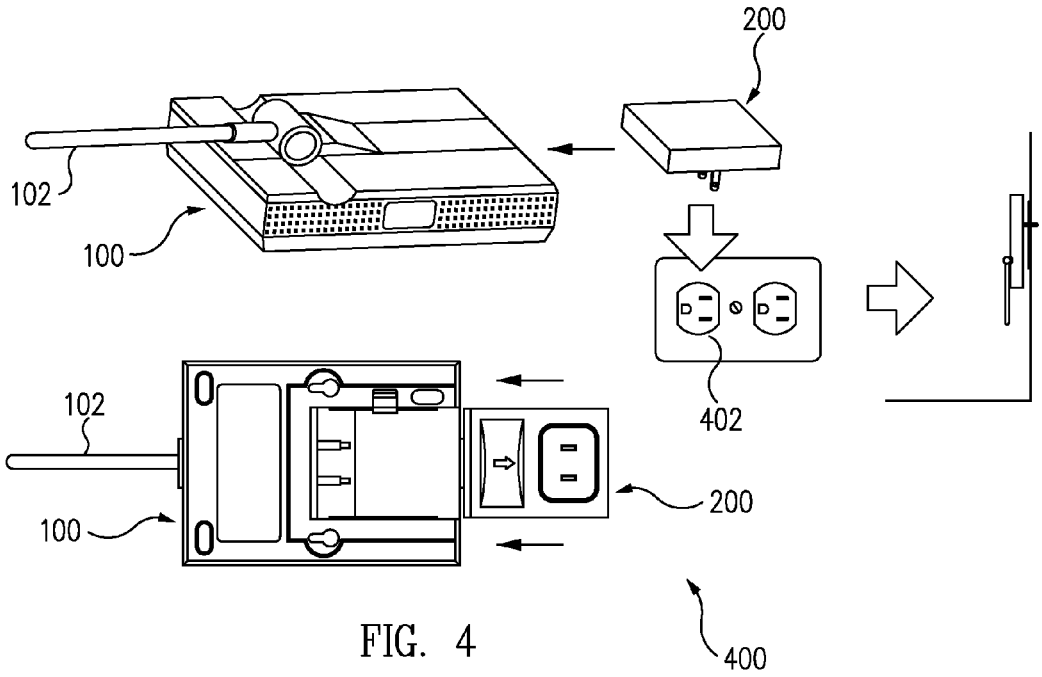
FIG. 4 illustrates the insertion of the power connector of FIG. 2 into the electrical device of FIG. 1 and into a power outlet in accordance with an embodiment of the present invention.

FIG. 4 provides a diagram 400, which further illustrates the exemplary insertion of power connector 200 of FIG. 2 into electrical device 100 of FIG. 1 and into a power outlet 402 in accordance with an embodiment of the present invention. As shown in diagram 400, power connector 200 is inserted into electrical device 100. Power connector 200, joined with electrical device 100, may then be inserted into power outlet 402 so that electrical power may be provided to electrical device 100 (e.g., through prongs 202 and terminals 206 and 106).

When power connector 200, joined with electrical device 100, is inserted into power outlet 402, power connector 200 securely holds electrical device 100. Consequently, if power outlet 402 is located on a wall a certain distance above the floor, for example, power connector 200 may be designed to hold or suspend electrical device 100 so that electrical device 100 does not touch the floor. Note also that antenna 102 of electrical device 100 may be positioned (e.g., rotated) to a desired direction or orientation and is shown in a different position than is shown, for example, in FIG. 1*a*.

Figure 5A:
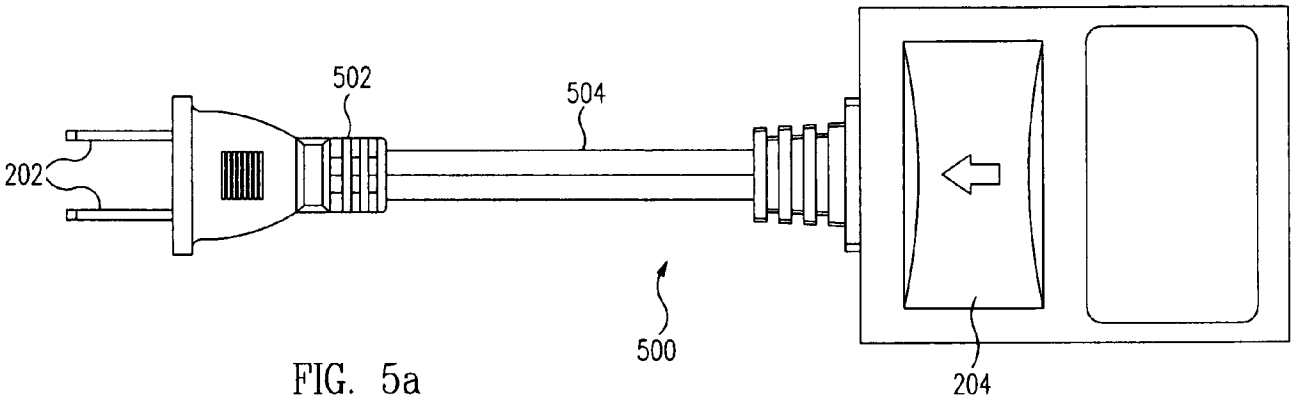
FIGS. 5*a*, 5*b*, and 5*c* show bottom, side, and end views illustrating a power connector for the electrical device of FIG. 1 in accordance with an embodiment of the present invention.
Figure 5B:
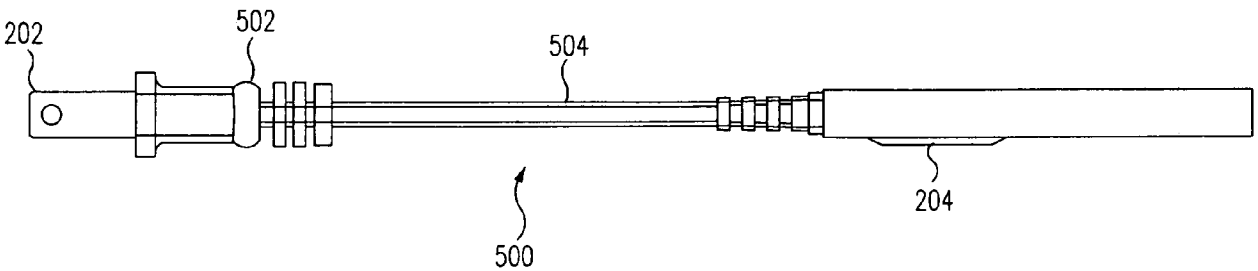
Figure 5C:
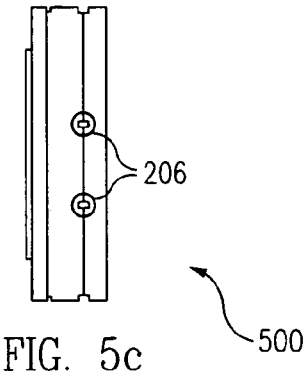

FIGS. 5*a*, 5*b*, and 5*c* show bottom, side, and end views illustrating a power connector 500 for electrical device 100 of FIG. 1 in accordance with an embodiment of the present invention. Power connector 500 is similar to power connector 200 (FIG. 2), but power connector 500 includes a plug 502 and a cord 504 so that power connector 500 may plug into an external power source and supply power to electrical device 100. Electrical device 100 may be some distance away from the external power source (i.e., the distance being limited by the length of cord 504, which may be of any length desired).

Power connector 500 includes prongs 202 on plug 502, for insertion into an electrical outlet, and terminals 206 for connecting to terminals 106 of electrical device 100 (FIG. 1). Raised portion 204 may also be included to aid in the insertion and removal of power connector 500 to and from electrical device 100.

Figure 6A:
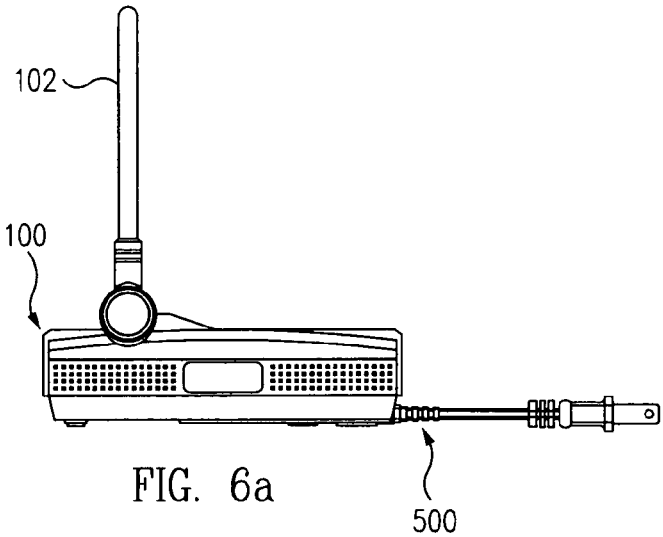
FIGS. 6*a*, 6*b*, and 6*c* show front, side, and bottom views illustrating the power connector of FIG. 5 coupled to the electrical device of FIG. 1 in accordance with an embodiment of the present invention.
Figure 6B:
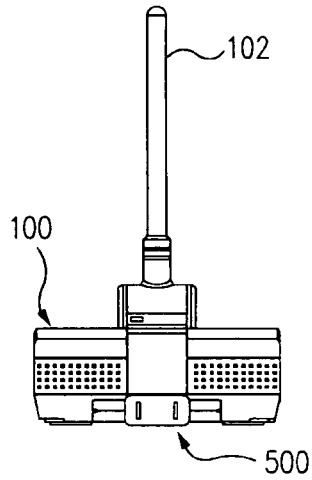
Figure 6C:
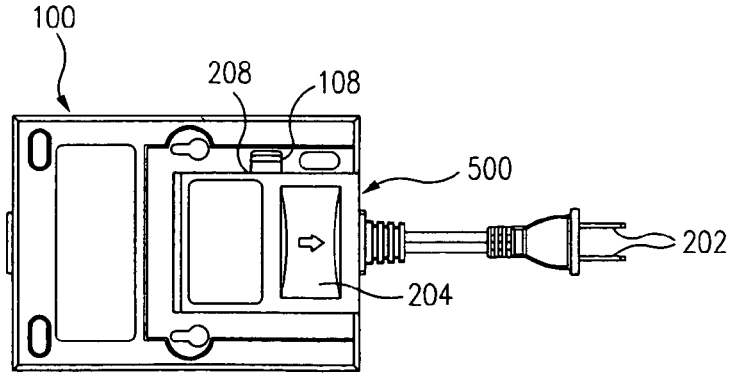

As an exemplary implementation, FIGS. 6*a*, 6*b*, and 6*c* show front, side, and bottom views illustrating power connector 500 of FIG. 5 coupled to electrical device 100 of FIG. 1 in accordance with an embodiment of the present invention. When power connector 500 is inserted into electrical device 100 for this example, terminals 106 are joined (or mated) with terminals 206 to provide an electrical connection. Power connector 500 may be latched into place via latch 108 that snaps into indentation 208.

Figure 7:
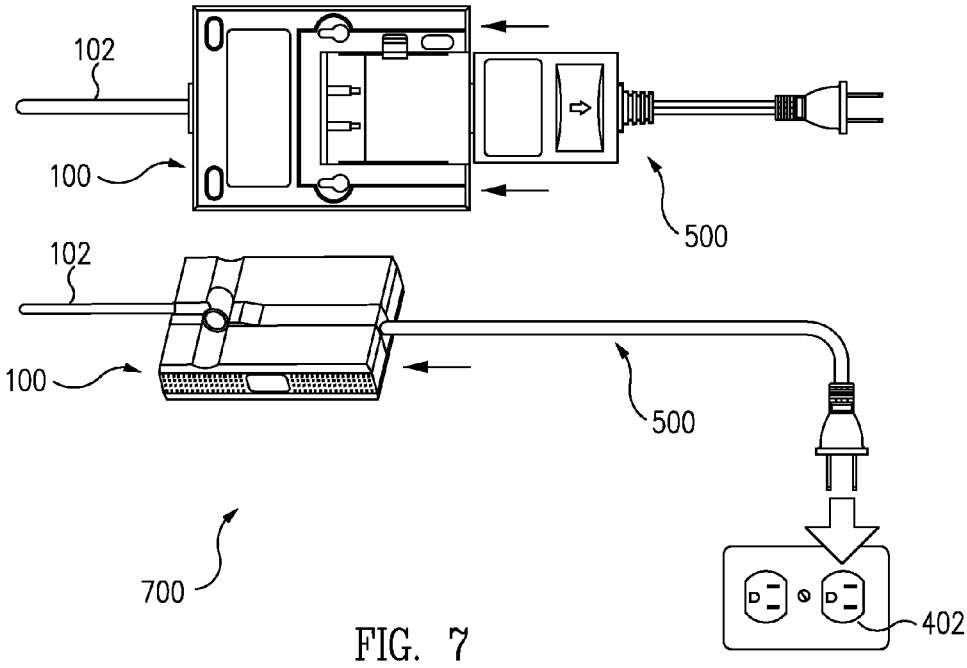
FIG. 7 illustrates the insertion of the power connector of FIG. 5 into the electrical device of FIG. 1 and into a power outlet in accordance with an embodiment of the present invention.

FIG. 7 provides a diagram 700, which further illustrates the exemplary insertion of power connector 500 of FIG. 5 into electrical device 100 of FIG. 1 and into power outlet 402 in accordance with an embodiment of the present invention. As shown in diagram 700, power connector 500 is inserted into electrical device 100. Plug 502 of power connector 200 may then be inserted into power outlet 402 so that electrical power may be provided to electrical device 100 (e.g., through prongs 202, cord 504, and terminals 206 and 106).

Power connectors 200 and 500 may be shaped as desired, depending upon the desired application and shape or size of electrical device 100, so that power connector 200 or 500 may be securely joined with electrical device 100. Power connector 200 generally must be securely joined, for example, so that when power connector 200 is inserted into power outlet 402, power connector 200 can securely support electrical device 100.

As noted above, prongs 202 may be implemented in any number and any shape, depending upon the intended applications. For example, there may be one, two, three, or more prongs and shaped as shown or rounded or positioned at different angles relative to each other to accommodate the various types of electrical outlets and power sources found throughout the world.

Power connectors 200 and 500 may further include a power converter or a power transformer to convert the supplied electrical power to the desired power types as required by electrical device 100. For example, power connectors 200 and 500 may include a power converter or a power transformer to convert a 220 volts external source to 110 volts for electrical device 100. As another example, power connectors 200 and 500 may include a power transformer to convert an external power supply voltage of 220 volts and 50 Hertz to 110 volts and 60 Hertz for electrical device 100. As another example, power connectors 200 and 500 may include a power transformer to convert an external power supply voltage of alternating current to a direct current voltage (e.g., 110 volts alternating current to 5 volts direct current) for electrical device 100. Consequently, various types of power converters (e.g., such as power converter 200 or 500) may be provided for electrical device 100 to provide the desired connection configuration to connect electrical device 100 to an external power supply and also to convert the provided power to the required type and level.

Embodiments described above illustrate but do not limit the invention. It should also be understood that numerous modifications and variations are possible in accordance with the principles of the present invention. Accordingly, the scope of the invention is defined only by the following claims.

We claim:

1. A system comprising:

an electrical device having at least one terminal adapted to provide a path for electrical power to the electrical device;

two or more power connectors adapted to be selectively coupled to the at least one terminal of the electrical device, wherein only one of the power connectors at a time is selectively coupled to provide a path for electrical power from an external power supply to the electrical device, and wherein each of the power connectors includes a power converter and/or a power transformer, with the power converter and/or power transformer disposed substantially within a perimeter of the electrical device when the power connector is coupled to the at least one terminal of the electrical device, with each of the power connectors comprising:

at least one power terminal adapted to couple to the corresponding terminal of the electrical device; and at least one electrical prong adapted to couple to the external power supply;

wherein a first one of the power connectors is adapted to selectively couple to the at least one terminal of the electrical device, with the at least one electrical prong of the first power connector protruding substantially perpendicularly from a side of the electrical device when the first power connector is coupled to the at least one terminal of the electrical device, and with the at least one electrical prong adapted to plug directly into an electrical outlet of the external power supply; and wherein a second one of the power connectors is adapted to selectively couple to the at least one terminal of the electrical device and further comprises an electrical cord adapted to couple the at least one electrical prong to the at least one power terminal, with the at least one electrical prong adapted to plug directly into an electrical outlet of the external power supply via the electrical cord.

2. The system of claim 1, wherein each of the power connectors further comprises a raised portion to provide a user of the electrical device an area to apply pressure to the power connector to aid in coupling the power connector to the electrical device or decoupling the power connector from the electrical device.

3. The system of claim 1, wherein the at least one electrical prong for one of the power connectors comprises two or three electrical prongs adapted to be inserted into an electrical outlet of the external power supply, and wherein the electrical cord and the at least one power terminal of the second power connector are aligned substantially parallel to the side of the electrical device when the second power connector is coupled to the at least one terminal.

4. The system of claim 1, wherein the at least one terminal comprises two terminals, the at least one power terminal comprises two corresponding power terminals, and the at least one electrical prong comprises two electrical prongs to provide the path for electrical power from the external power supply to the electrical device.

5. The system of claim 1, wherein the first one of the power connectors is adapted to support the electrical device when the at least one electrical prong of the power connector is coupled to the external power supply.

6. The system of claim 5, wherein the first one of the power connectors suspends the electrical device above the floor when the at least one electrical prong of the power connector is coupled to a power outlet of the external power supply, and wherein the electrical device further comprises a latch and the first power connector further comprises an indentation, with the latch and corresponding indentation securing the first power connector to the electrical device when the first power connector is coupled to the electrical device.

7. A plurality of power connectors for selectively coupling one at a time to an electrical device, the power connectors comprising:

a first power connector having a plurality of first electrical prongs for coupling to a power supply and a plurality of first power terminals for coupling to corresponding terminals of the electrical device, wherein the first power connector includes a power converter and/or a power transformer, with the power converter and/or power transformer disposed substantially within a perimeter of the electrical device when the first power connector is coupled to the corresponding terminals of the electrical device, with the first electrical prongs protruding substantially perpendicularly from a side of the electrical device when the first power connector is coupled to the corresponding terminals of the electrical device, and wherein the first power connector supports the electrical device while the first power connector is coupled to the power supply; and a second power connector having an electrical cord and a plurality of second electrical prongs for coupling to the power supply via the electrical cord, the second power connector further having a plurality of second power terminals for coupling to the electrical cord and to the corresponding terminals of the electrical device, wherein the second power connector includes a power converter and/or a power transformer, with the power converter and/or power transformer disposed substantially within a perimeter of the electrical device when the second power connector is coupled to the corresponding terminals of the electrical device, wherein the first power connector or the second power connector is selectively coupled to the electrical device.

8. The power connectors of claim 7, wherein each of the power connectors further comprises a raised portion to provide a user of the electrical device an area to apply pressure to the power connector to aid in coupling the power connector to the electrical device or decoupling the power connector from the electrical device.

9. The power connectors of claim 7, wherein the first electrical prongs and the second electrical prongs are adapted to plug into an electrical outlet of the power supply, and wherein the electrical cord and the second power terminals of the second power connector are aligned substantially parallel to the side of the electrical device when the second power connector is coupled to the corresponding terminals of the electrical device.

10. The power connectors of claim 7, wherein the first power connector is adapted to support the electrical device above a surface area below the electrical device when the first electrical prongs are inserted into an electrical outlet of the power supply.

11. A method of providing power from a power supply to an electrical device, the method comprising:

providing two or more power adapters adapted to selectively couple to the electrical device and provide a path for power from the power supply to the electrical device, wherein each of the power adapters includes a power converter and/or a power transformer, with the power converter and/or power transformer disposed substantially within a perimeter of the electrical device when the power adapter is coupled to the electrical device, wherein a first one of the power adapters couples the electrical device directly to the power supply via one or more electrical prongs which protrude substantially perpendicularly from a side of the electrical device when the first power adapter is coupled to the electrical device, and a second one of the power adapters has an electrical cord with a plug and one or more electrical prongs to couple the electrical device to the power supply;

selecting which of the power adapters to couple to the electrical device;

coupling the selected power adapter to the electrical device; and coupling the selected power adapter, which is coupled to the electrical device, to the power supply.

12. The method of claim 11, further comprising providing power conversion for the electrical device via the selected power adapter, and wherein each of the power adapters further comprises a raised portion to provide a user of the electrical device an area to apply pressure to the power adapter to aid in the coupling of the selected power adapter to the electrical device.

13. The method of claim 11, wherein the first one of the power adapters, when coupled to an electrical wall outlet of the power supply, supports the electrical device and suspends the electrical device above a surface that is below the electrical wall outlet.

14. A system comprising:

an electrical device having at least one terminal for providing a path for electrical power to the electrical device; and means for selectively coupling the at least one terminal of the electrical device to an external power supply, wherein the coupling means comprises at least a first coupling means and a second coupling means which are selectively coupled one at a time to the at least one terminal of the electrical device, the first coupling means adapted to directly couple the at least one terminal of the electrical device to an electrical outlet of the external power supply and suspend the electrical device from the electrical outlet, the second coupling means adapted to couple the at least one terminal to the electrical outlet which is distant from the electrical device, wherein the first coupling means and the second coupling means each includes means for transforming and/or converting the power provided by the external power supply, with the transforming and/or converting means disposed substantially within a perimeter of the electrical device when the first coupling means or the second coupling means is selectively coupled to the at least one terminal of the electrical device.

15. The system of claim 14, wherein the first and second coupling means each further comprises a raised portion to provide a user of the electrical device an area to apply pressure to aid in coupling the first coupling means or the second coupling means to the electrical device or decoupling the first coupling means or the second coupling means from the electrical device.

16. The system of claim 14, wherein the first coupling means suspends the electrical device from the electrical outlet and above a surface below the electrical outlet of the external power supply.

* * * * *